US011969665B2

(12) United States Patent
Badie et al.

(10) Patent No.: US 11,969,665 B2
(45) Date of Patent: Apr. 30, 2024

(54) REVERSIBLE TOY WITH COUPLING APPENDAGES

(71) Applicant: TEE TURTLE, LLC, Hazelwood, MO (US)

(72) Inventors: Ramy Adly Badie, High Ridge, MO (US); Michael Thai Ly, Lafayette, CO (US); Charles Anthony Gaines, Jr., Denver, CO (US); Shea Koch Pack, Bridgeton, MO (US); Alexander William Braun, Denver, CO (US)

(73) Assignee: TEE TURTLE, LLC, Hazelwood, MO (US)

( * ) Notice: Subject to any disclaimer, the term of this patent is extended or adjusted under 35 U.S.C. 154(b) by 20 days.

(21) Appl. No.: 17/325,659

(22) Filed: May 20, 2021

(65) Prior Publication Data

US 2022/0370926 A1 Nov. 24, 2022

(51) Int. Cl.
*A63H 3/02* (2006.01)
*A63H 3/36* (2006.01)

(52) U.S. Cl.
CPC ..... *A63H 3/02* (2013.01); *A63H 3/365* (2013.01)

(58) Field of Classification Search
CPC ..... A63H 3/02; A63H 3/365
USPC ..... 446/139, 321
See application file for complete search history.

(56) References Cited

U.S. PATENT DOCUMENTS 1,396,766 A * 11/1921 McClelland ..... A63H 3/12 446/321
1,551,050 A * 8/1925 Parsons ..... A63H 3/36 446/139
1,966,986 A * 7/1934 Martin ..... A63H 3/12 446/321
3,789,547 A * 2/1974 Chemarin ..... A63H 3/02 446/385
3,851,419 A * 12/1974 Kaelin ..... A63H 3/12 446/321
4,387,530 A * 6/1983 Miller ..... A63H 33/00 428/14
4,781,648 A * 11/1988 Garfinkel ..... A63H 33/004 446/369
5,362,271 A * 11/1994 Butt ..... A63H 3/36 446/139
9,975,053 B1 * 5/2018 Sutton ..... A63H 3/365
(Continued)

FOREIGN PATENT DOCUMENTS

WO WO-0064551 A1 * 11/2000 ..... A63H 3/12
WO WO-2006100419 A1 * 9/2006 ..... A63H 3/12
WO WO-2008016315 A1 * 2/2008 ..... A63H 3/02

*Primary Examiner* — Nini F Legesse
(74) *Attorney, Agent, or Firm* — Dorsey & Whitney LLP

(57) ABSTRACT

A reversible toy includes a body having a first surface and a second surface opposite the first surface. The body may be reversible between a first configuration and a second configuration to alternatingly present the first and second surfaces as an outer body surface defining an exterior of the body. In this regard, the other of the first and second surfaces may alternatingly define a stored body surface defining an interior cavity within the body. The reversible toy may further include an appendage attached to the body at the first surface and comprising a coupling feature. The coupling feature may be configured to couple the reversible toy to an object at the appendage.

19 Claims, 8 Drawing Sheets

(56) References Cited

U.S. PATENT DOCUMENTS

| | | | | |
|---|---|---|---|---|
| 2010/0112892 | A1* | 5/2010 | LaPointe | A63H 3/02 446/72 |
| 2015/0290547 | A1* | 10/2015 | May | A63H 3/36 446/369 |
| 2019/0184298 | A1* | 6/2019 | Badie | A63H 3/02 |
| 2019/0358553 | A1* | 11/2019 | Murphy | A63H 3/02 |

* cited by examiner

REVERSIBLE TOY WITH COUPLING APPENDAGES

FIELD

The described embodiments relate generally to toys, such as plus toys.

BACKGROUND

Plush toys, such as stuffed animals and other characters, may have many different formats and characteristics. Some toys may even come in "sets" along with related characters. However, these toys currently may not include features in which to couple the related characters together. As such, the need continues for systems and techniques to facilitate the coupling of plush toys.

SUMMARY

In one example, a reversible toy is disclosed. The reversible toy includes a body including a first surface and a second surface opposite the first surface. The body is reversible between a first configuration and a second configuration to alternatingly present the first and second surfaces as an outer body surface defining an exterior of the body. The other of the first and second surfaces alternatingly defines a stored body surface defining an interior cavity within the body. The reversible toy further includes an appendage attached to the body at the first surface and comprising a coupling feature. The coupling feature is configured to couple the reversible toy to an object at the appendage.

In another example, a reversible toy is disclosed. The reversible toy includes a body having a first material layer and a second material layer. The body is reversible between a first configuration and second configuration. In the first configuration, the first material layer defines an outer body surface of the body and the second material layer defines an interior cavity of the body. In the second configuration, the second material layer defines the outer body surface and the first material defines the interior cavity. The reversible toy further includes a coupling appendage attached to the first material layer and comprising a coupling feature. The coupling appendage is alternatingly positionable between the outer body surface and the interior cavity based on a configuration of the body in the first or second configurations. The reversible toy further includes a non-coupling appendage attached to the second material layer. The non-coupling appendage is alternatingly positionable between the outer body surface and the interior cavity based on a configuration of the body in the first or the second configurations.

In another example, a reversible toy is disclosed. The reversible toy includes a first material layer and a second material layer cooperating to define a body. The first material layer and the second material layer are coupled by a stitched edge defining an opening extending into an interior cavity. The body is collapsible through the opening and reversible between a first configuration and a second configuration to alternatingly present the first material layer and the second material layer as an outer body surface defining an exterior of the body. The other of the first and the second material layers alternatingly define a stored body surface defining the interior cavity. The reversible toy further includes a coupling appendage attached to the first material layer and configured to move relative to the first material layer to releasably couple the reversible toy to an object. The reversible toy further includes a non-coupling appendage attached to the second material layer and configured to move based on movement of the second material layer.

DETAILED DESCRIPTION

Figure 1:
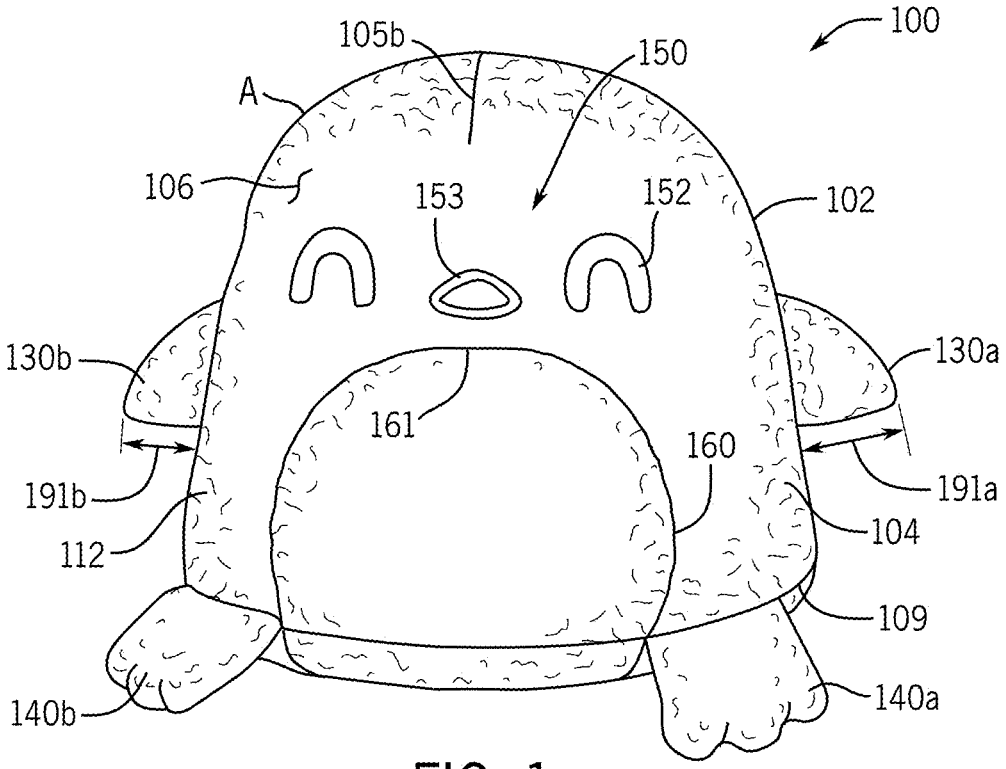
FIG. 1 depicts a front view of a reversible toy in a first configuration.

The description that follows includes sample systems, methods, and apparatuses that embody various elements of the present disclosure. However, it should be understood that the described disclosure may be practiced in a variety of forms in addition to those described herein.

The following disclosure relates generally to plush toys that may be convertible or reversible between a first configuration and a second configuration. In the first configuration, the plush toy may be coupleable with another object, such as another plush toy. In the second configuration, the plush toy may lack the ability to couple with another object, such as another plush toy. In some embodiments, the ability to couple with another object may be selected to match with an aesthetic element of the plush toy, e.g., a first configuration may have a "happy" face and including the coupleable functionality and a second configuration may have a "sad" or "angry" face and not include the coupleable functionality. In this example, the plush toy may, for example, "hold hands" with another plush toy in the "happy" configuration and will not "hold hands" with another plush toy in the "sad" or "angry" configuration.

An example plush toy includes a body having a first body surface and a second body surface opposite the first body surface. A stuffing material, such as a loose fill, a foam, soft beads, compressible material or items, and so on, may separate the first and the second surfaces from one another, e.g., may be positioned between the two surfaces. The stuffing material may generally allow for the relative movement of the first and the second surfaces relative to one another and relative to the stuffing material. The stuffing material may also establish a plushness, squishy, or soft feel of the plush toy. The body may generally define an interior cavity having an opening and an opposing closed top end. In the first configuration, the first surface may define the outer body surface and the second surface may define a stored body surface that defines the interior cavity within the body. The body may be manipulated in order to reversibly convert the plush toy into the second configuration in which the second surface defines the outer body surface and the first surface defines the stored body surface. For example, the first and the second surfaces may be compressed and collapsed through the opening to alternatingly present the first and second surfaces as the outer body surface defining the exterior of the body; and the other of the first and second surfaces alternatingly defining the stored body surface defining the interior cavity.

The plush toy may include the appendages associated with each of the first and second surfaces. In some configurations the appendages may be the same shape, dimension, and located in the same relative position on both surfaces, but in other configurations may be differently configured. The appendages may extend from and travel with the respective first and second surfaces. In this regard, the appendages associated with the first surface may alternatingly be arranged on the outer body surface and the stored body surface, and appendages associated with the second surface may alternatingly be arranged on the stored body surface and the outer body surface. For example, the appendages may be configured to deform and collapse through the opening with the respective first and second surfaces.

In one implementation, a coupling appendage is associated with the first surface and a non-coupling appendage is associated with the second surface. The coupling appendage may include a coupling feature, such as a magnet, configured to releasably couple the reversible plush toy to another object at the coupling appendage. For example, the coupling feature may exert an attraction force configured to releasably secure, affix, attach, associate, or join the reversible plush toy to another object, such as another reversible plush toy. The coupling feature may be concealed within a material defining the appendage, which may obscure the functionality of appendage upon visual inspection, which may allow a more "magical" type of experience for the user when the toy can be coupled to another. The non-coupling appendage may be free from any coupling feature, including being free from any magnetic material. In this regard, the non-coupling appendage may not be configured to couple the reversible plush toy to another object.

The plush toy may be configured to selectively couple with another object based on the body being in the first or second configurations. In the first configuration, the first surface and the associated coupling appendage may define or otherwise be arranged at the outer body surface. This may allow the coupling appendage to selectively couple to another object using the coupling feature. The reversible plush toy may be manipulated in order to arrange the second surface and the associated non-coupling appendage to define the outer body surface while arranging the coupling appendage at the stored body surface and interior cavity. This may prevent the plush toy from coupling to another object. For example, the stuffing material and/or material layers of the body may operate to attenuate the attraction force from the coupling appendage held in the interior cavity and the non-coupling appendage on the exterior is free from a coupling feature.

Facial features, marking, graphical elements, or other indicia on the first and/or the second surface may indicate a configuration of the plush toy and the function of the associated appendages. As one example, the first surface may include facial features that resemble a happy demeanor, including eyes, lips, or the like, recognizable as warm or playful. These facial features may provide an indication that the plush toy is in a configuration in which the appendage at the outer body surface is a coupling appendage capable of selectively coupling the reversible toy to another object, such as another reversible toy. Further, the second surface may include facial features that resemble an unpleasant demeanor, including eyes, lips, or the like, recognizable as harsh or confrontational. These facial features may provide an indication that the plush toy is in a configuration in which the appendage at the outer body surface is a non-coupling appendage not capable of selectively coupling the reversible toy to another object. Other graphical elements may be used as well, such as icons, patches, etc. that may be reflective of a "state" of the toy, e.g., able to connect to other toys or unable to connect.

Turning to the drawings, FIGS. 1-4 depict a reversible toy 100 in a first configuration A. FIGS. 5-8 depict the reversible toy 100 in a second configuration A'. As described herein, the reversible toy 100 is configured to convert or transition, reversibly between the first configuration A and the second configuration A'. In this regard, it will be appreciated the features and components described with respect to a presenting exterior of the reversible toy 100 in the first configuration A, may be substantially concealed within an interior of the reversible toy 100 in the second configuration A'. Alternatingly, features and components described with respect to a presenting exterior of the reversible toy in the second configuration A', may be substantially concealed within an interior of the reversible toy 100 in the first configuration A.

The reversible toy 100 includes a body 102. The body 102 may include a first material layer 104 and a second material layer 108. The first and second material layers 104, 108 may be formed at least partially from a fabric material, including cloths, felts, and fibrous materials, having various textures. For example, the first or second material layers 104, 108 may be formed at least partially from a smooth material, such as a nylon. In other cases, the first or second material layers 104, 108 may be formed from a texturally rough but plush material, such as certain high thread count fabrics.

Figure 9:
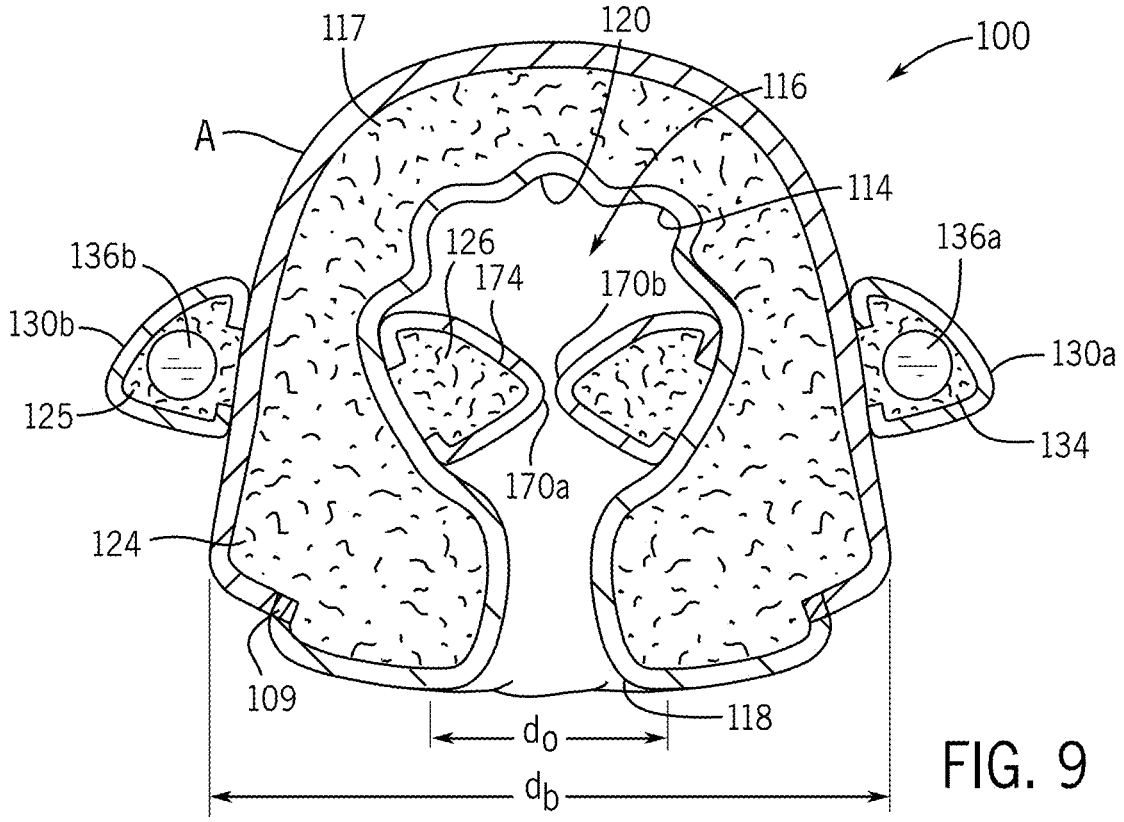
FIG. 9 depicts a cross-sectional view of the reversible toy of FIG. 1, taken along line 9-9 of FIG. 4.

The body 102 further includes a stuffing material 124, as shown in FIG. 9, arranged within an inner body cavity 117 defined between the first and second material layers 104, 108. The stuffing material 124 may include a loose fill, a foam, soft beads, compressible items, and other types of materials. More broadly the stuffing material 124 may substantially any material that provides a soft feel or plushness to the reversible toy 100 and may act to fill a "volume" or define a structure or shape for the body. The stuffing material 124 may be a separate material from the first and second material layers 104, 108 of the body 102. In some cases, the stuffing material 124 may be resiliently deformable, allowing the body 102 to be compressed with the application of force, and return to an uncompressed shape when the force ceases. Accordingly, the reversible toy 100, and any of the reversible toys described herein, may be a plush toy; however, this is not required. In other cases, some or substantially all of the reversible toy 100 may be defined by a rigid structure, including plastic and other layers that may operate to stiffen portions of the reversible toy 100. Where implemented, the rigid structure may be elastically deformable, such as may be the case for certain plastic and metal materials that are formed as a layer or sheet of material. In other cases, the rigid structure may include more brittle or substantially inflexible components, such as may be the case where the rigid structure defines a solid, cast- or extrusion-molded structure for the reversible toy 100, such as extremity.

The first material layer 104 may define a first surface 106 of the body 102, as shown in FIGS. 1-4. The first surface 106 may define an outer body surface 112 of the reversible toy 100 in the first configuration A. The outer body surface 112 may be an outer or exterior surface of the reversible toy 100 that is visible to a user when the reversible toy 100 is in the first configuration A. The outer body surface 112 may be configured to resemble the shape of an animal, a cartoon character, a human, or other shape, including fanciful and arbitrary shapes. It should be noted that in some embodiments, the shape may be selected based on an aesthetic appearance in addition to a shape that is readily transformative into the interior body surface. In some cases, the first surface 106 may include several material layers coupled to one another in order to define the outer body surface 112. In these cases, the first surface 106 may include a composite or patchwork of materials. For example as shown in the example FIG. 1, the first surface 106 includes a patch portion 160. The patch portion 160 and/or other any other portions of the reversible toy 100 that form the first surface 106 may be at least partially formed from a fabric material substantially analogous to the first and second material layers 104, 108. Accordingly, it will be appreciated that any reference herein to a first surface may include a plurality of materials or material sections, while in other case, a single material section or piece may be used, that is, the material for a body surface may be integrally formed.

Figure 2:
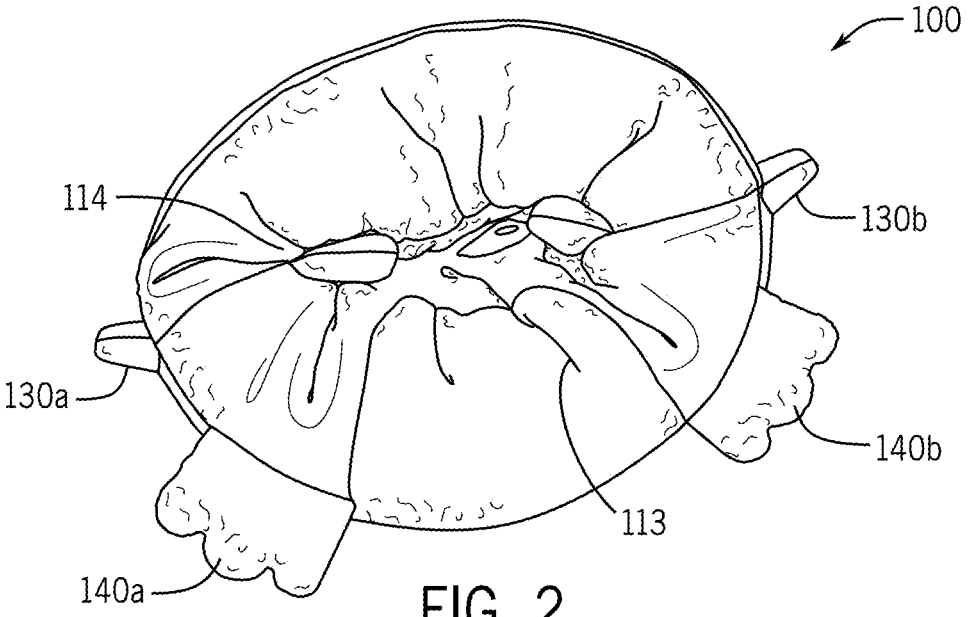
FIG. 2 depicts a bottom view of the reversible toy of FIG. 1.

In the first configuration A, the second material layer 108 may define a second surface 110 that may define a stored body surface 114. The stored body surface 114, as shown in FIG. 9, may be an interior surface of the reversible toy 100 when the reversible toy 100 is in the first configuration A. The stored body surface 114 may define an interior cavity 116 having an opening 118 and an opposing closed top end 120. The second material layer 108 may be partially compressed or manipulated and have creases 113 about the opening 118, as shown in FIG. 2. The opening 118 is shown in FIG. 9 as having a diameter $d_o$ and the body 102 is shown as having a diameter $d_b$, which may correspond to a maximum diameter of the body 102. The diameter do may be less than the diameter $d_b$, such as having a value of at least three-fourths the diameter $d_b$, of at least one-half the diameter $d_b$, of at least one-fourth the diameter $d_b$ or less.

In the second configuration A', the second material layer 108 may define the second surface 110 as an outer body surface 112' of the reversible toy 100. The outer body surface 112' may be an outer or exterior surface of the reversible toy 100 visible to a user when the reversible toy 100 is in the second configuration A'. The outer body surface 112' may be substantially analogous to the outer body surface 112 configured to resemble the shape of an animal, a cartoon character, a human, or other shape, including fanciful and arbitrary shapes. As with body surface 112, the body surface 112' may be selected based on aesthetic features, as well as a shape that is readily transformative into the alternate body shape. The outer body surfaces 112, 112' may have substantially the same shape or dimension. Further, the second surface 110 may also include several material layers coupled to one another in order to define the outer body surface 112'. In this regard, the second surface 110 may include a composite or patchwork of materials or material sections or portions. For example as shown in the example FIG. 5, the second surface 110 includes a patch portion 162. The patch portion 162 and/or other any other portions of the reversible toy 100 that form the second surface 110 may be at least partially formed from a fabric material substantially analogous to the first and the second material layers 104, 108. Accordingly, it will be appreciated that any reference herein to a second surface may include a plurality of materials, while in other cases, a single material may be used, e.g., a single integral material section may be used or multiple sections coupled together may be used. In this regard, the optional patch work construction of the second surface 110 may also define the interior cavity 116 when the reversible toy 100 is in the first configuration A.

Figure 6:
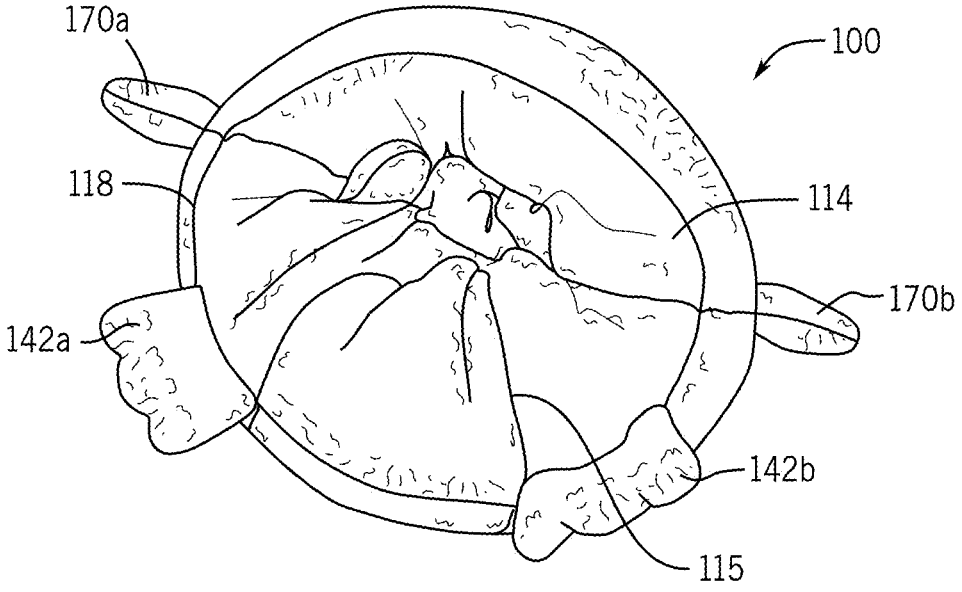
FIG. 6 depicts a bottom view of the reversible toy of FIG. 5.
Figure 11:
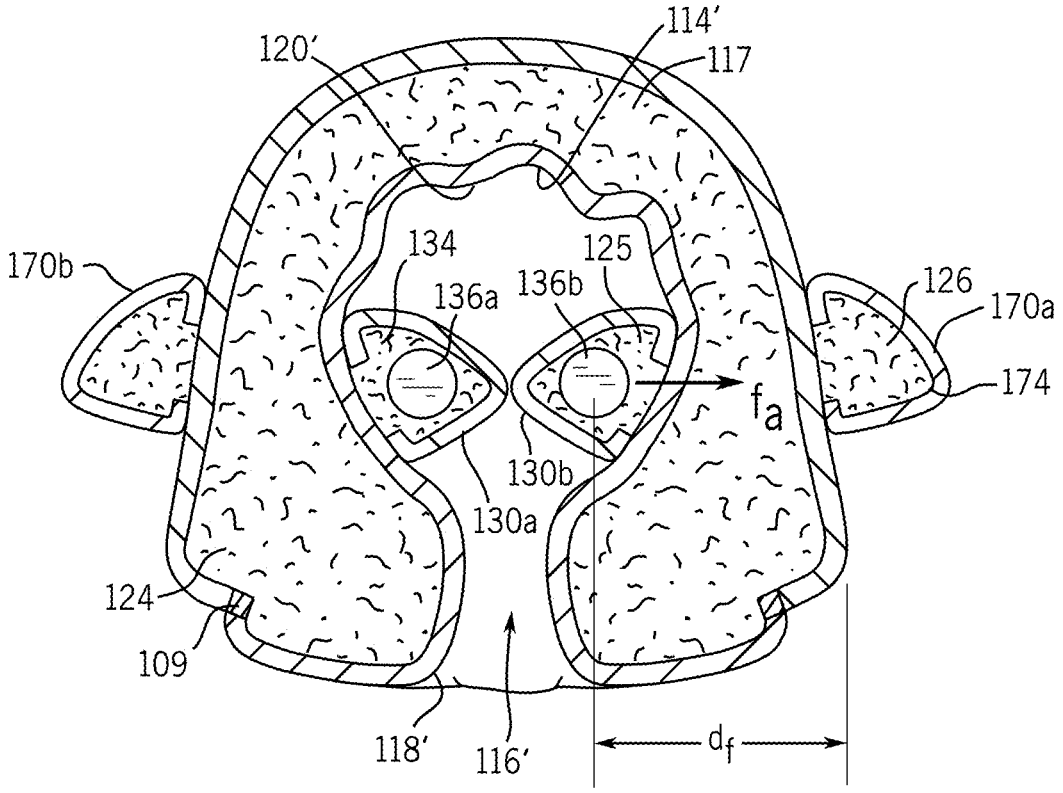
FIG. 11 depicts a cross-sectional view of the reversible toy of FIG. 5, taken along line 11-11 of FIG. 8.

Further, in the second configuration A', the first material layer 104 may define a portion of the first surface 106 that defines a stored body surface 114'. The stored body surface 114', as shown in FIG. 11, may be an interior surface of the reversible toy 100 when the reversible toy 100 is in the second configuration A'. In this regard, the optional patch work construction of the first surface 106, as described above, may also define the interior cavity 116'. As shown in FIG. 11, the stored body surface 114' may define an interior cavity 116' having an opening 118' and an opposing closed top end 120'. The first material layer 104 may be partially compressed or manipulated and have creases 114 about the opening 118', as shown in FIG. 6. The opening 118' may have a diameter that is the same or substantially similar to the diameter $d_o$ of the opening 118.

The reversible toy 100 may include various appendages associated with the first surface 106 or the second surface 110. Some appendages may be configured to cause a coupling of the reversible toy 100 with another object, such as another reversible toy, whereas other appendages lack the ability to cause such coupling, and may otherwise be decorative in nature. With reference to the first surface 106 and as shown in FIGS. 1-4, the reversible toy 100 may include a first coupling appendage **130*a* and a second coupling appendage 130*b*. The first and second coupling appendages 130*a*, 130*b* may be configured to releasably secure, affix, attach, associate, or join the reversible toy 100 to another object. The first and second coupling appendages 130*a*, 130*b* may resemble the shape of wing, arm, tentacle, or other extremity that may be selected to match an artistic rendering of the body shape, character, or the like. In the example of FIGS. 1-4, the first coupling appendage 130*a* has a first appendage length 191*a* and a second coupling appendage 130*b* has a second appendage length 191*b*. The first and second lengths 191*a*, 191*b* may be less than the maximum width of the body 102, such as having a value of at least half the width of the body 102, of at least one-fourth the width of the body 102, of at least one-eighth the width of body 102, or less. In this regard, the first and second lengths 191*a*, 191*b* may be configured to mitigate or prevent the first and second coupling appendages 130*a*, 130*b* from coupling with one another. For example, where the first and second lengths 191*a*, 191*b* are around at least half the width of the body 102 or less, the body 102 may interrupt or prevent from the first and second coupling appendages 130*a*, 130*b* from coupling with one another, as the respective lengths 191*a*, 191*b* may be insufficient for the first and second coupling appendages 130*a*, 130*b* to overcome the size of the body 102. In other examples, the first and second lengths 191*a*, 191*b* may be larger, such as may be the case where it is desirable that the coupling appendages have the optional functionality of coupling with one another and/or where the body 102 defines a character, animal, or other design that has a diminutive or reduced size as compared with coupling appendages 130***a*, 130*b*. While FIG. 1 shows the first and second lengths as being substantially equal, this is not required.

Figure 3:
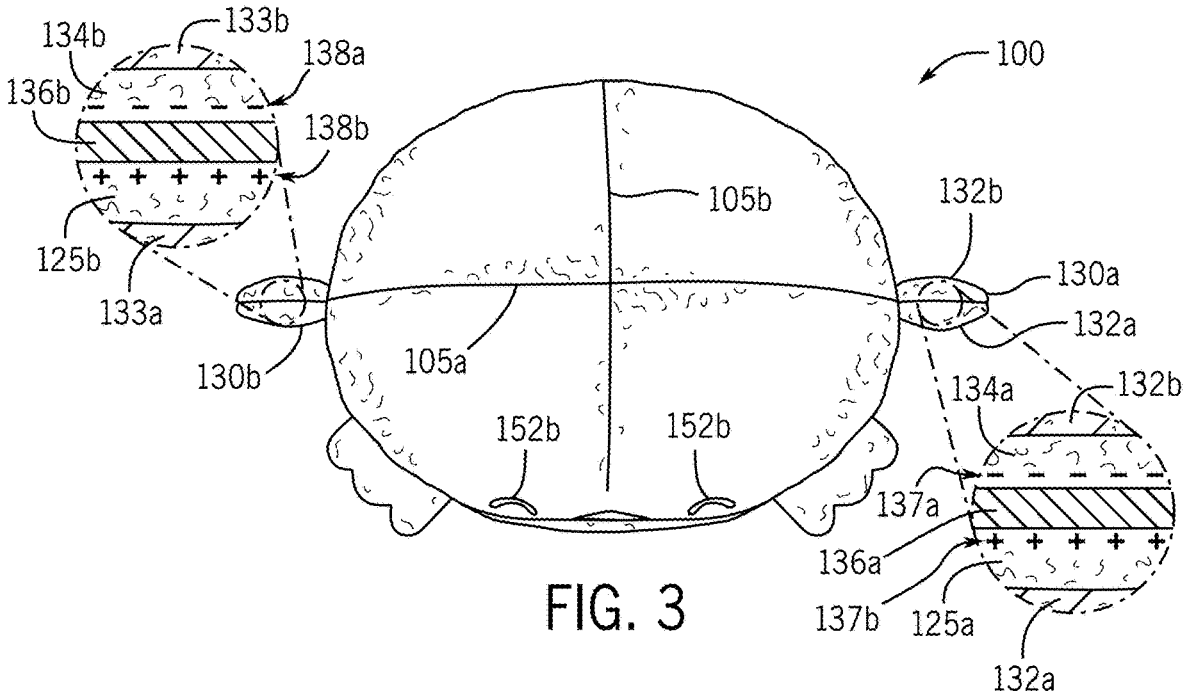
FIG. 3 depicts a top view of the reversible toy of FIG. 1.
Figure 4:
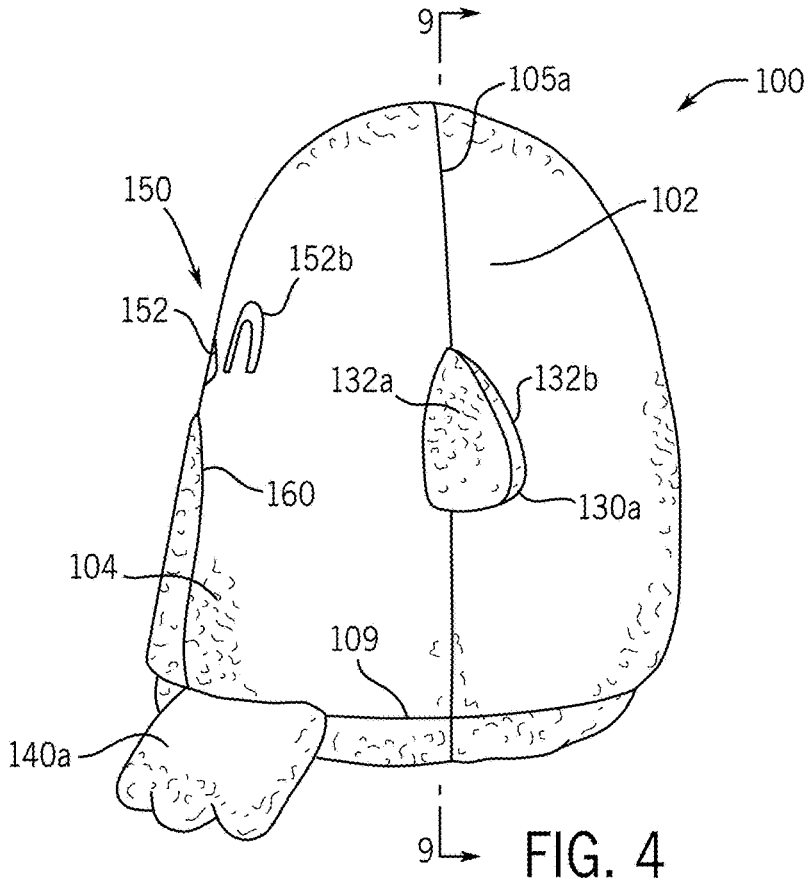
FIG. 4 depicts a side view of the reversible toy of FIG. 1.

As shown in FIG. 3, the first coupling appendage 130*a* may include a first coupling appendage material 132*a* and a second coupling appendage materials 132*b*. The first and second coupling appendage materials 132*a*, 132*b* may be a fabric material substantially analogous to the first or second material layers 104, 108. While shown in FIG. 3 as separate materials, the first and second coupling appendage materials 132*a*, 132*b* may in other cases be portions of the first material layer 104. The first and second coupling appendage materials 132*a*, 132*b* may define a substantially flat outer or exterior surface of the coupling appendage 130*a*. The first and second coupling appendage materials 132*a*, 132*b* may define a pocket 134*a* or cavity. The pocket 134*a* may be filled with a coupling appendage stuffing material 125*a*. The coupling appendage stuffing material 125*a* may be similar to the stuffing material 124 and may separate the first and second coupling appendage materials 132*a*, 132*b* from one another to define a shape of the pocket 134*a*. In some cases, the coupling appendage stuffing material 125*a* may be omitted. The second coupling appendage 130*b* may be substantially analogous to the first coupling appendage 130*a* and includes a first coupling appendage material 133*a*, a second coupling appendage material 133*b*, a pocket 135*b*, and a coupling appendage stuffing material 125*b*, redundant explanation of which is omitted for clarity.

As illustrated in the cutaway view of FIG. 3, the first coupling appendage 130*a* may include a first coupling feature 136*a*. The first coupling feature 136*a* may be or include magnets or more generally magnetic features. In this regard, the first coupling feature 136*a* may have a first or negative magnetic polarity 137*a* on a first side and a second or positive magnetic polarity 137*b* on a second opposing side. The first coupling feature 136*a* may be arranged such that the polarity 137*a* is aligned or substantially parallel with the flat exterior surface defined by the second coupling appendage material 132*b*. Further, the first coupling feature 136*a* may be arranged such that the polarity 137*b* is aligned or substantially parallel with the flat exterior surface defined by the first coupling appendage material 132*a*. The arrangement of the first coupling feature 136*a* may therefore allow the first coupling feature 130*a* to be releasably coupled with a coupling feature of another toy. For example, and as shown and described in greater detail below with respect to FIG. 14, the arrangement of the first coupling feature 136*a* with the polarizations 137*a*, 137*b* adjacent or parallel with the materials 132*a*, 132*b* or "palms" of the first coupling feature 130*a*, may allow the first coupling feature 130*a* to overlap with the "palm" or coupling feature of another toy in an overlapping manner. Similarly, the second coupling feature 130*b* may include a second coupling feature 136*b* having a first or negative magnetic polarity 138*a*, and a second or positive magnetic polarity 138*b*.

The first coupling feature 136*a* may be associated with the coupling appendage stuffing material 125*a* in the first coupling appendage 130*a*. For example, the coupling appendage stuffing material 125*a* may be a loose fill or other material, and the first coupling feature 136*a* may be engaged with the loose fill of the coupling appendage stuffing material 125*a* in the first coupling appendage 130*a*. In some cases, the coupling appendage stuffing material 125*a* may substantially surround the first coupling feature 136*a*. For example, a portion of the coupling appendage stuffing material 125*a* may be placed along a first side of the first coupling feature 136*a* (e.g., a side having the first magnetic polarity 137*a*) and another portion of the coupling appendage stuffing material 125*a* may be placed along an opposing second side of the first coupling feature 136*a* (e.g., a side having the second magnetic polarity 137*b*). In this regard, the coupling appendage stuffing material 125*a* may be arranged to conceal a tactile feel of the first coupling feature 136*a*. Further, the coupling appendage stuffing material 125*a* may be configured to have a thickness relative to the first coupling feature 136*a* that does not impair or impede or attenuate the magnetic force of the first coupling feature 136*a*. The second coupling feature 136*b* may be similarly arranged with the coupling appendage stuffing material 125*b*.

With further reference to the appendages of FIGS. 1-4, the reversible toy 100 may include a first auxiliary appendage 140*a*, and a second auxiliary appendage 140*b*. The first and second auxiliary appendages 140*a*, 140*b* may resemble the shape of a foot or other extremity. Other examples, include, tentacles, arms, legs, or the like and may be varied based on the character or aesthetic features of the toy. The first and second auxiliary appendages 140*a*, 140*b* may generally be free of magnetic materials or other coupling features. In other cases, the first and second auxiliary appendages 140*a*, 140*b* may include a coupling feature, similar to the coupling features 136*a*, 136*b* described above.

The reversible toy further includes various appendages visible in the second configuration A'. As shown in FIGS. 5-8, the reversible toy 100 may include a first non-coupling appendage 170*a* and a second non-coupling appendage 170*b*. The first and second non-coupling appendages 170*a*, 170*b* may resemble the shape of wing or other extremity. In the example of FIGS. 5-8, the first and second non-coupling appendages 170*a*, 170*b* have a size and/or shape substantially analogous to the coupling appendages 130*a*, 130*b* described above. For example, the first and/or second non-coupling appendages 170*a*, 170*b* may be less than the maximum width of the body 102, such as having a value of at least half the width of the body 102, of at least one-fourth the width of the body 102, of at least one-eighth the width of body 102, or less. While FIG. 1 shows the first and second lengths as being substantially equal, this is not required.

Figure 7:
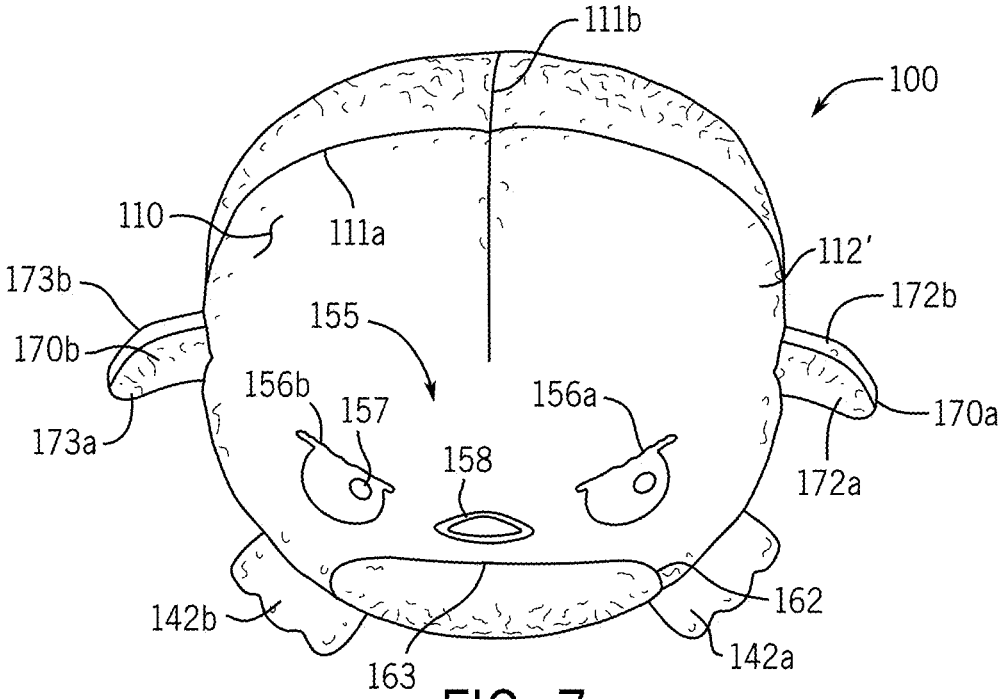
FIG. 7 depicts a top view of the reversible toy of FIG. 5
Figure 8:
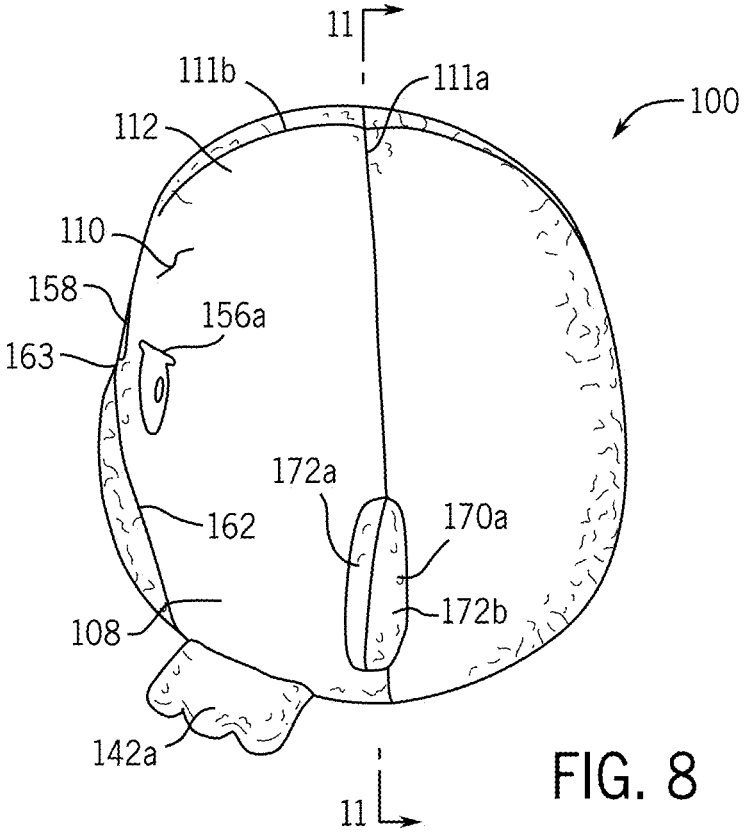
FIG. 8 depicts a side view of the reversible toy of FIG. 5.

As shown in FIG. 7, the first non-coupling appendage 170*a* may include a first coupling appendage material 172*a* and a second coupling appendage materials 172*b*. The first and second coupling appendage materials 172*a*, 172*b* may be a fabric material substantially analogous to the first or second material layers 104, 108. While shown in FIG. 7 as separate materials, the first and second coupling appendage materials 172*a*, 172*b* may in other cases be portions of the second material layer 108. The first and second coupling appendage materials 172*a*, 172*b* may having a stuffing material arranged therebetween, such as any of the stuffing materials described herein. The first non-coupling appendage 170*a* may generally be free of any coupling features or magnetic materials, i.e., the non-coupling appendage includes only material and optionally stuffing. The second non-coupling appendage 170*b* may be substantially analogous to the first non-coupling appendage 170*a* and include a first coupling appendage material 173*a*, a second coupling appendage material 173*b*, and optional stuffing material held therein. In this regard, the first and second non-coupling appendages 170*a*, 170*b* may have more stuffing material by volume than the stuffing material of the coupling appendages 130*a*, 130*b*, for example, to account or make up for the lack of magnetic material or other coupling member in the non-coupling appendages 170*a*, 170*b*. The reversible toy may further include a third auxiliary appendage 140*c*, and a fourth auxiliary appendage 140*d*, similar to the first and second auxiliary appendages described above, redundant explanation of which is omitted for clarity.

With further reference to the appendages of FIGS. 1-4, the reversible toy 100 may include a first auxiliary appendage 140*a*, and a second auxiliary appendage 140*b*. The first and second auxiliary appendages 140*a*, 140*b* may resemble the shape of a foot or other extremity. The first and second auxiliary appendages 140*a*, 140*b* may generally be free of magnetic materials or other coupling features. In other cases, the first and second auxiliary appendages 140*a*, 140*b* may include a coupling feature, similar to the coupling features 136*a*, 136*b* described above.

The reversible toy 100 may further include various features that may provide an indication of the reversible toy 100 being in the first configuration A or the second configuration A'. In other words, the body features may correspond to a coupling or connective state of the toy Broadly, the body 102 or other portion of the reversible toy may include graphics, logos, or other indicia that indicate the reversible toy 100 is in the first configuration A'. For example, the indicia may provide an indication that the reversibly toy 100 is in a state in which the reversible toy 100 is capable of joining to another object, such as another toy. For example and as shown in FIG. 1, the reversible toy 100 includes a face region 150. The face region 150 may include a collection of indicia, symbols, marking, patches, and so on that cooperate to provide an indication that the reversible toy 100 is in the first configuration A. In the present example, the face region 150 includes a collection of features that resemble a face having of a happy demeanor, including eyes 152 and a beak 153. The eyes 152 may aesthetically contribute to the happy demeanor of the face region 150, such as having a shape or color that is recognized as warm, playful, or friendly. The beak 153 may aesthetically contribute to the happy demeanor of the face region 150, such as by forming a smile, or alternatively the beak 153 may be a generally emotionally neutral feature of the face. The eyes 152 and beak 153 may be cartoonish in nature in order to emphasize an emotional state of the face region 150. Each of the eyes 152 and the beak 153 may be separate fabric layers (or a composite of fabric layers). In some cases, some or all of the eyes 152 and the beak 153 may be portions of the first material layer 104, such as a dyed or otherwise demarcated portion of the first material layer 104 that forms the foregoing facial features. The face region 150 is presented in the first configuration A with the appendages 130*a*, 130*b* extending from the body 102. The presentation of the face region 150 having the happy demeanor may indicate that the appendages 130*a*, 130*b* are coupling appendages having a coupling feature, and hence the reversible toy 100, with the happy demeanor, is in a configuration that allows the reversible toy 100 to couple with another object, such as another reversible toy.

Figure 5:
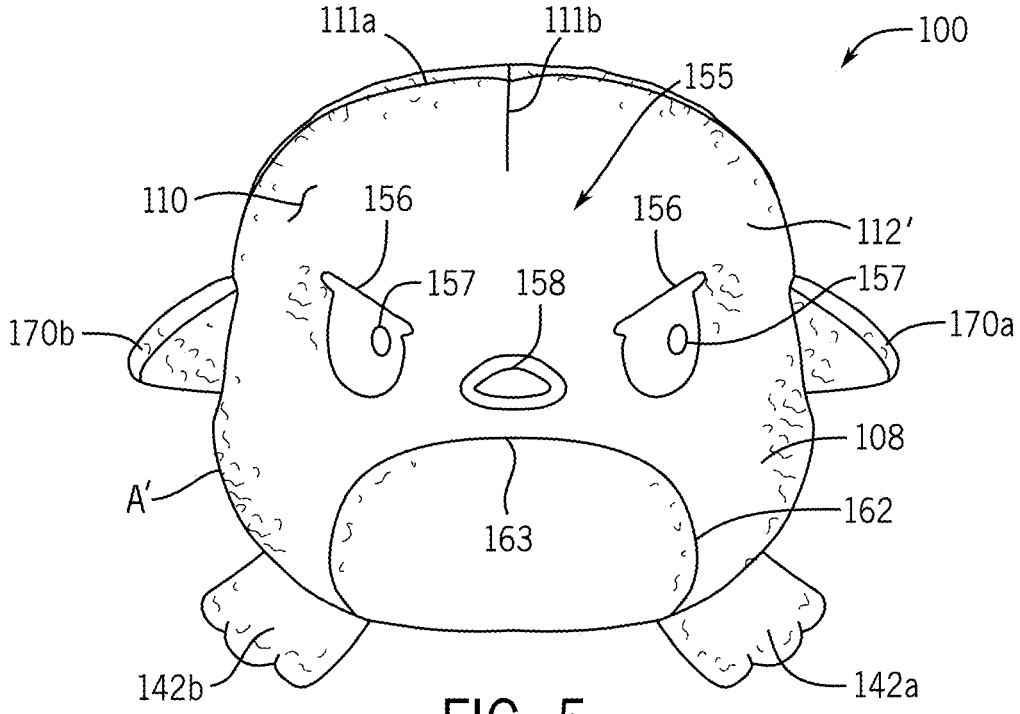
FIG. 5 depicts a front view of the reversible toy of FIG. 1 in a second configuration.

In the second configuration A', as shown in FIG. 5, the reversible toy 100 includes a face region 155. The face region 155 may include a collection of indicia, symbols, marking, patches, and so on that cooperate to provide an indication that the reversible toy 100 is in the second configuration B. In the present example, the face region 155 includes a collection of features that resemble a face having an unpleasant demeanor, including eyes 156, pupils 157, and a beak 158. Sample unpleasant demeanors include anger, sadness, and disgust. The eyes 156 may aesthetically contribute to the unpleasant demeanor of the face region 150, such as having a shape or color that is recognized as harsh, confrontational, or unapproachable. The pupil 157 may emphasize the unpleasant demeanor. The beak 158 may aesthetically contribute to the unpleasant demeanor of the face region 155, such as by forming a frown, or alternatively the beak 158 may be a generally emotionally neutral feature of the face. The features of the second face region 155 may be constructed in manner similar to the features of the first region 150 described above, including being formed from separate material layers and/or being partially or fully integrated with the second material layer 108. The face region 155 is presented in the second configuration A' with the appendages 170*a*, 170*b* extending from the body 102. The presentation of the face region 155 having the unpleasant demeanor may indicate that the appendages 170*a*, 170*b* are non-coupling appendages, and hence the reversible toy 100, with the unpleasant demeanor, is in a configuration that prevents the reversible toy 100 from coupling with another object, such as another reversible toy.

The reversible toy 100 may be coupled such that the first material layer 104 and second material layer 108 are coupled to one another to define the internal cavity 116 therebetween. For example, the reversible toy 100 may include a stitching 109 used to join the first and second material layers 104, 108. The first and second material layers 104, 108 may be joined to one another with the stitching 109 about the openings 118, 118'. The stitching 109 may including a thread, an elastic or other structure to physically attach the first and second material layers 104, 108 to one another. In some cases, the stitching 109 may define a stitching ring, which may define a circular shape of the first and second material layers 104, 108 about the openings 118, 118'. Additionally or alternatively, a retaining ring, such as a plastic or metal ring, may be used in conjunction or in place of the stitching 109. In any construction, the stitching 109 may allow the openings 118, 118' to maintain a substantially constant diameter $d_o$, during a manipulation of the reversible toy, such as a reversible conversion between the first and second configurations A, A'. While the stitching 109 is shown for purposes of illustration as a substantially circular shape, it will be appreciated the stitching 109 may take the form of substantially any shape in order to facilitate a coupling of the first and second materials layers 104, 108. For example, the stitching 109 may be configured in a shape that may match a shape of the body 102, including shapes that include sharp angles and/or shapes that are irregular or that may vary as the reversible toy 100 is manipulated. Additionally or alternatively, the stitching 109 may couple the first and second material layers 104, 108 and define an undulating edge of the reversible toy 100. For example, the stitching 109 may define a terminal bottom edge of the reversible toy 100 that forms a sinusoidal or wave-like pattern. One such undulating edge is described in U.S. patent application Ser. No. 16/422,260, entitled "Dual Body Convertible Toy with Flexible Bottom Edge," of which is incorporated by reference herein.

Figure 10:
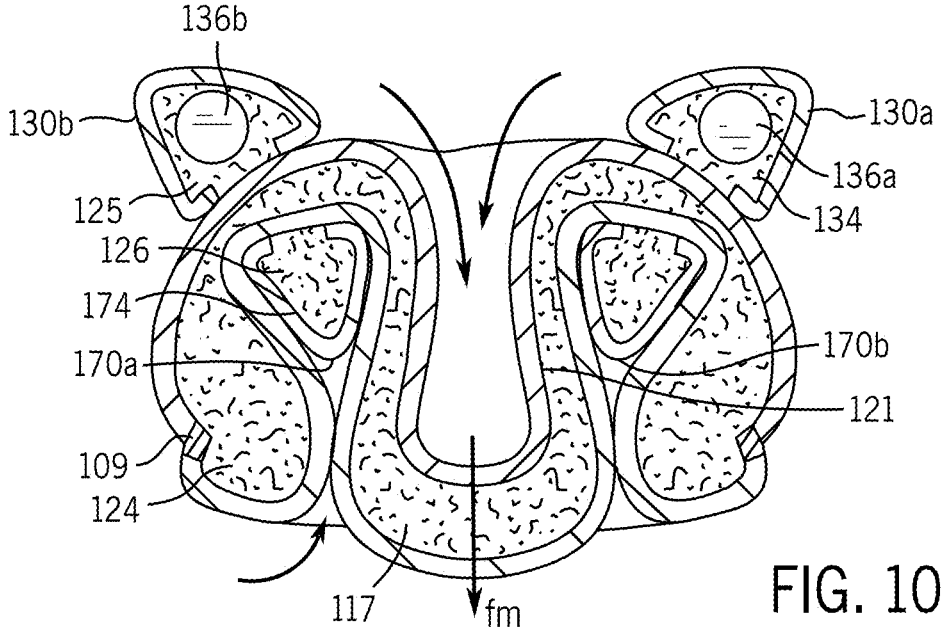
FIG. 10 depicts a cross-sectional view of the reversible toy of the present disclosure being transitioned between the first configuration and the second configuration.

The first and second material layers 104, 108 may be coupled to one another in a manner that traps the stuffing material 124 within the inner body cavity 117, as shown in FIGS. 9-11. For example, the first and second material layers 104, 108 may be coupled to one another along the stitching 109 in order to define the inner body cavity 117. The stuffing material 124 may be arranged within the inner body cavity 117. The stitching 109 may close the inner body cavity 117 in order to prevent the stuffing material 124 from exiting the inner body cavity 117. In this manner, the stuffing material 124 may be trapped in the inner body cavity 117. The stuffing material 124 may be trapped in the inner body cavity in a manner that permits movement of the stuffing material 124 and first and second material layers 104, 108. For example, the first and second material 104, 108 may allow the stuffing material 124 to move substantially freely within the inner body cavity 117. Similarly, the stuffing material 124 may allow the first and second material layers 104, 108 to move relative to one another. The stuffing material 124 may be arranged in the inner body cavity 117 to fill substantially the entire volume. In this regard, the stuffing material 124 may help maintain a shape of the body 102 by pressing against the first and second materials layers 104, 108 to define a full shape of the body 102. The stuffing material 124 may have sufficient structure to define a shape of the body.

The first material layer 104 may be coupled to define the first surface 106. While many constructions are possible, FIGS. 1-4 shows the first material layer 104 including a front and back portions coupled along a seam 105*a*, as shown in FIG. 3. The first material layer 104 may also be coupled with a transverse seam 105*b* that extends extend substantially perpendicularly relative to the seam 105*a* along a topmost portion of the body 102. The seams 105*a*, 105*b* may operate to shape the first material layer 104 to define a partial dome shape at the topmost portion of the body 102. As shown in FIG. 1, the transverse seam 105*b* may end above the face region 150, which may relax the first material layer 104 at the face region 150 to define a more cylindrical or bulbous shape of the body 102.

In the patchwork embodiment of FIG. 1, the patch portion 160 may be coupled to the first material layer 104 along a seam 161. The patch portion 160 may be arranged over the first material layer 104. In other cases, the patch portion 160 and the first material layer 104 may be substantially abutting along the seam 161. Where defined by separate fabric portions, the eyes 152 and beak 153 may also be stitched to the first material layer 104 along one or more seams. The coupling appendages 130*a*, 130*b* and the auxiliary appendages 140*a*, 140*b* may also be stitched to the first material layer 104. In the illustrated examples, the coupling appendages 130*a*, 130*b* may be stitched to the first material layer 104 so that the pockets 134*a*, 134*b* are separate or isolated from the inner body cavity 117. In other cases, the coupling appendages 130*a*, 130*b* may be stitched to the first material layer 104 to define the pockets 134*a*, 134*b* as continuous with or extend from the inner body cavity 116.

The first and second material layers 104, 108 may be coupled to one another in a manner that traps the stuffing material 124 within the inner body cavity 117, as shown in FIGS. 9-11. The stuffing material 124 may be trapped in the inner body cavity 117 in a manner that permits movement of the stuffing material 124 and first and second material layers 104, 108. For example, the first and second material 104, 108 may allow the stuffing material 124 to move substantially freely within the inner body cavity 117. Similarly, the stuffing material 124 may allow the first and second material layers 104, 108 to move relative to one another. The stuffing material 124 may be arranged in the inner body cavity 117 to fill substantially the entire volume. In this regard, the stuffing material 124 may help maintain a shape of the body 102 by pressing against the first and second materials layers 104, 108 to define a full shape of the body 102, e.g., the stuffing material expands against the material layers to define the shape of the body.

The second material layer 108 may be coupled to define the second surface 110. While many constructions are possible, FIGS. 5-8 shows the second material layer 108 including a front and back portions coupled along a seam 111*a*, as shown in FIG. 7. The second material layer 108 may also be coupled with a transverse seam 111*b* that extends extend substantially perpendicularly relative to the seam 111*a* along a topmost portion of the body 102. The seams 111*a*, 111*b* may operate to shape the second material layer 108 to define a partial dome shape at the topmost portion of the body 102. As shown in FIG. 5, the transverse seam 111*b* may end above the face region 155, which may relax the second material layer 108 at the face region 155 to define a more cylindrical or bulbous shape of the body 102. In this regard, the body 102 may have substantially the same shape and/or dimensions in each of the first and second configurations A, A'. In the patchwork embodiment of FIG. 5, the patch portion 162 may be coupled to the second material layer 108 along a seam 163. The patch portion 162, the eyes 156, pupils 157, beak 158, non-coupling appendages 170*a*, 170*b*, third auxiliary appendage 142*a*, fourth auxiliary appendage 142*b* may be coupled with the second body material in a manner similar to like components of the first material layer 104, described above.

In operation, the reversible toy 100 is configured to convert, reversibly, between a first configuration A and a second configuration A'. FIGS. 9-11 show a progression of cross-sectional views that show the operation of the reversible toy 100 undergoing a reversible conversion between the first configuration A and the second configuration A'. With reference to FIG. 9, the reversible toy is shown in the first configuration A. In the first configuration A, the first material layer 104 defines the outer body surface 112 and the second material layer 108 define the stored body surface 114. As shown in FIG. 9, the coupling appendages 130*a*, 130*b* are arranged along an exterior of the body 130. This may allow the coupling features 136*a*, 136*b* to releasable couple the reversible toy to another object at the coupling appendages 130*a*, 130*b*, such as another object having magnetic properties. The lengths 191*a*, 191*b* of the coupling appendages may be sufficiently small such that that coupling appendages 130*a*, 130*b* are prevented from coupling to the same surface simultaneously. The first and second material layers 104, 108 may be compressed, deformed, or otherwise manipulated in order to collapse the body 102 through the opening 118 and define the second configuration A'.

For example and with reference to FIG. 10, the reversible toy 100 is shown receiving a manipulation force $f_m$. The manipulation force $f_m$ may be a force that causes the first and second materials 104, 108 at the closed top end 120 to compress toward one another and move toward and through the opening 118. This may cause a collapse or otherwise abrupt, non-linear deformation of the body 102. As the first and second materials 104, 108 move towards and through the opening 108, the opening 118, a compressed region 121 may be defined between the first and second material layers 104, 108. For example, diameter $d_o$ of the opening 118 may be less than the diameter $d_b$ of the body 102, and the diameter opening $d_o$ may generally remain substantially constant throughout the transformation between the first and second configurations A, A'. This may cause the first and second material layers 104, 108 to define the compressed region 121 in order to pass through the opening 118. The stuffing material 124 may be compressed between the first and second material layers 104, 108 at the compressed region 121. As the first and second material layers 104, 108 are advanced through and out of the opening 118, the first and second material layers 104, 108 may cease compressing the stuffing material 124, allowing the stuffing material 124 to return to an uncompressed shape.

The reversible toy 100 may continue to receive the manipulation force $f_m$ until the first and second material layers 104, 108 are advanced completely fully through the opening 118 in order to define the second configuration A', as shown in FIG. 11. In the second configuration A', the first and second material layers 104, 108 are alternated, swapped, inside out, or otherwise reversed from the arrangement of the layers in the first configuration A. For example, as shown in FIG. 11, in the second configuration, the first material layer 104 defines the stored body surface 114' and the second material layer 108 defines the outer body surface 112'.

In the second configuration A', the coupling appendages 130*a*, 130*b* are arranged within the interior cavity 116'. Accordingly, the coupling appendages 130*a*, 130*b* are separated from an exterior of the reversible toy 100 by a distance $d_f$, as defined by the first and second material layers 104, 108 and the stuffing material 124 trapped therebetween. The coupling features 136*a*, 136*b* may exert an attraction force $f_a$, as described herein. The attraction force $f_a$ may be attenuated by the first and second material layers 104, 108 and the stuffing material 124 such that the attraction force $f_a$ is not operable to cause a coupling of the reversible toy to another object, when the reversible toy 100 is in the second configuration A'.

Figure 12:
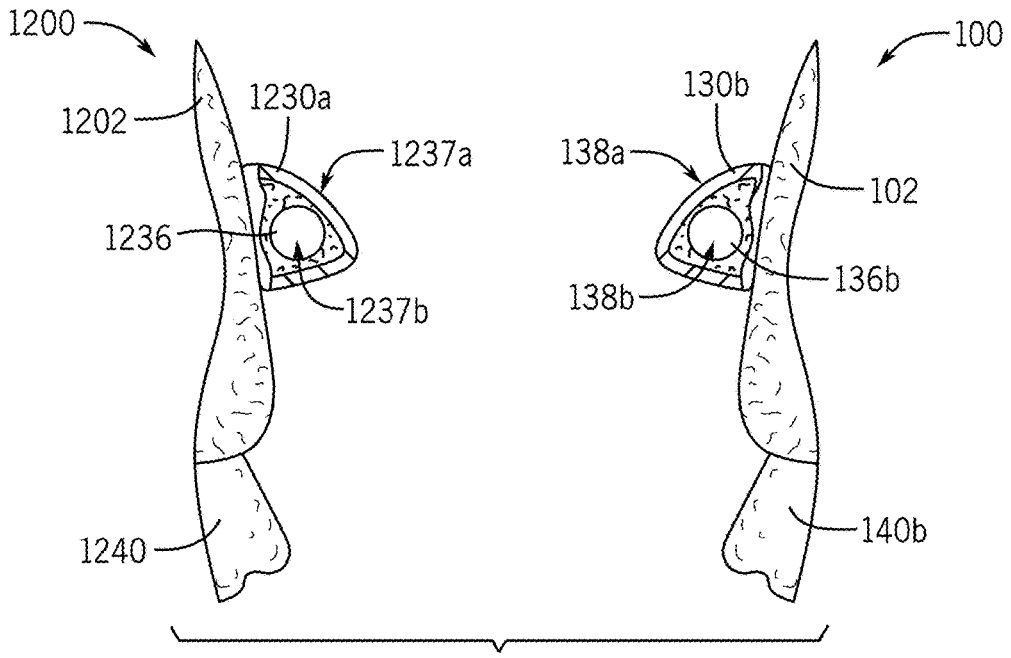
FIG. 12 depicts a pair of reversible toys with each reversible toy in a first configuration and separated from one another.
Figure 13:
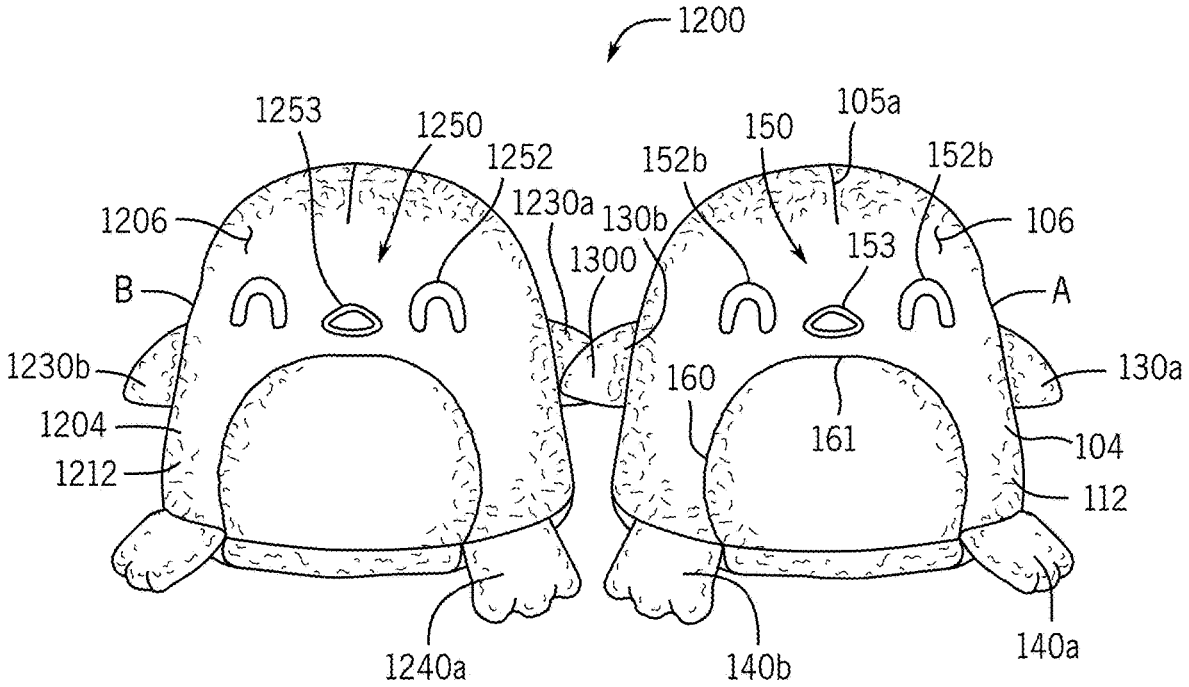
FIG. 13 depicts the pair of reversible toys of FIG. 12 with each reversible toy in the first configuration and releasably coupled to one another.
Figure 14:
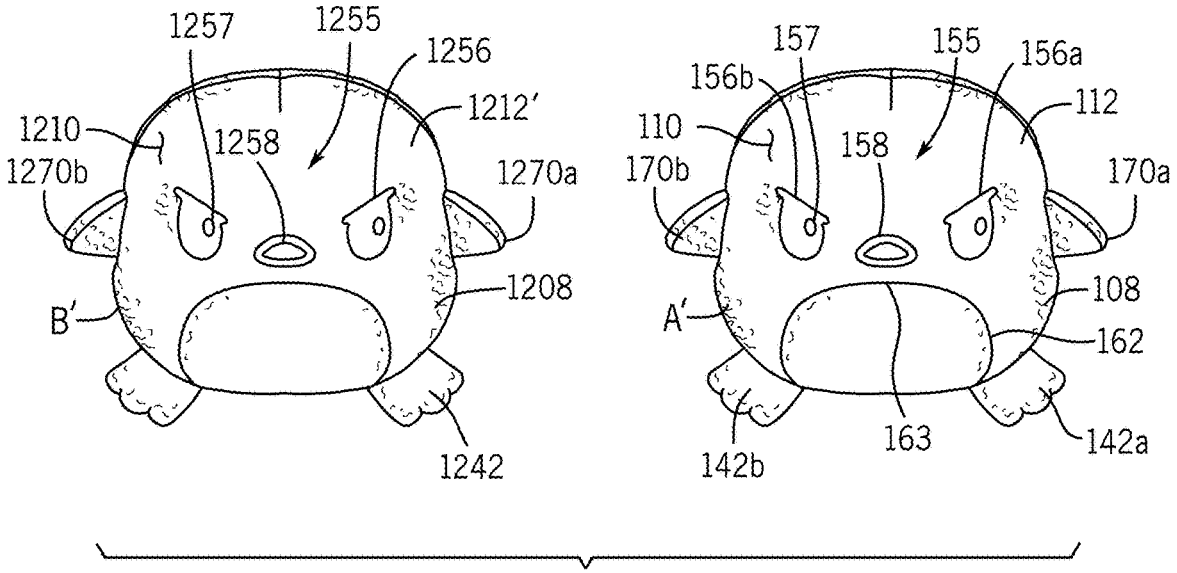
FIG. 14 depicts the pair of reversible toys of FIG. 12 with each reversible toy in a second configuration and separated from one another.

With reference to FIGS. 12-14, the reversible toy 100 may be selectively couplable with a second reversible toy 1200. The second reversible toy 1200 may be substantially analogous to the reversible toy 100 and include, a body 1202 having a first configuration B and a second configuration B', a first material layer 1204, a first surface 1206, a second material layer 1208, a second surface 1210, an outer body surface 1212, an outer body surface 1212', a first coupling appendage 1230*a*, a second coupling appendage 1230*b*, a coupling element 1236 having a first magnetic polarization 1237*a* and a second magnetic polarization 1237*b*, auxiliary appendages 1240, auxiliary appendages 1242, a face region 1250, eyes 1252, a beak 1253, a face region 1255, eyes 1256, pupils 1257, a beak 1258, a first non-coupling appendages 1270*a*, and a second non-coupling appendage 1270*b*, redundant explanation of which is omitted here for clarity.

With reference to FIG. 12, the reversible toy 100 and the second reversible toy 1200 may be arranged adjacent one another. The coupling features 136*b* may be arranged within the coupling appendage 130*b* of the reversible toy 100 such that the first magnetic polarity 138*a* is defined along a generally back-facing surface of the coupling feature 136*b* and the second magnetic polarity 138*b* is defined along a generally front-facing surface of the coupling feature 136*b*. Similarly, the coupling feature 1236 may be arranged within the coupling appendage 1230*a* such that the first magnetic polarity 1237*a* is defined along a generally back-facing surface of the coupling feature 1236 and the second magnetic polarity 1237*b* is defined along a generally front-facing surface of the coupling feature 1236. The respective polarizations of the coupling features 136*b*, 1236 may cause the second magnetic polarization 138*b* to be attracted to the first magnetic polarization 1237*a* and vice versa.

Accordingly and with reference to FIG. 13, the reversible toy 100 and the second reversible toy 1200 may be move toward one another surface that coupling appendages 130*b*, 1230*a* are coupled to one another. For example, the coupling appendages 130*b*, 1230*a* may be coupled to one another to define an overlap 1300. The overlap 1300 may define a lap joint or a layered connection. For example, at the overlap 1300, the generally back-facing surface of the coupling appendage 130*b* may be engaged with the generally front facing-surface of the coupling appendage 1230*a*, as the first magnetic polarity 138*a* and the second magnetic polarity 1237*b* attract one another. This may allow the coupling appendages 130*b*, 1230*a* to resemble or mimic human hand holding. For example, the generally front facing-surface of the coupling appendage 1230*a* may resemble a palm or surface of an open hand. And the generally back-facing surface of the coupling appendage 130*b* may resemble another surface of an open hand. Thus when the coupling appendages 130*b*, 1230*a* are releasably coupled and define the overlap 1300, the palm of the coupling appendage 1230*a* may resemble a holding of the "hand" of the coupling appendage 130*b*.

Conversely, the coupling appendages 130*b*, 1230*a* may be coupled with one another to define the overlap with the generally front-facing surface of the coupling feature 130*b* engaged with the generally back-facing surface of the coupling appendage 1230*a*. As described above, the generally happy demeanor of the face regions 150, 1250 may indicate that the reversible toy 100, 1200 are in a configuration in which the appendages are capable of coupling with one another. For example, the happy demeanor of the face regions 150, 1250 may provide an indication of friendliness or compassion that suggests a receptiveness to a hand holding. Thus a user may be prompted by the face regions 150, 1250 to attempt to releasably couple the reversible toys 100, 1200 to one another.

With reference to FIG. 14, the reversible toys 100, 1200 are show in the respective second configurations A', B'. As described above, the generally unpleasant demeanor of the face regions 155, 1255 may indicate that the reversible toys 100, 1200 are in a configuration in which the appendages are not capable of coupling with one another. For example, the unpleasant demeanor of the face regions 155, 1255 may provide an indication of unfriendliness that suggests a certain unreceptiveness to hand holding. Thus a user may be prompted by the face regions 155, 1255 to not attempt to releasably couple the reversible toys 100, 1200 to one another. And as the appendages of the reversible toys 100, 1200 along the exterior are non-coupling appendages in the second configuration of FIG. 15, the reversible toys 100, 1200 may not be coupleable with one another. Nevertheless, the appendages 170*a*, 1270*a* may be arranged adjacent one another or otherwise overlapped. However, despite the adjacent positioning, the appendages 170*b*, 1270*a* will not be capable of coupling to one another, for example, due to the lack of magnetic material contained therein.

Figure 15:
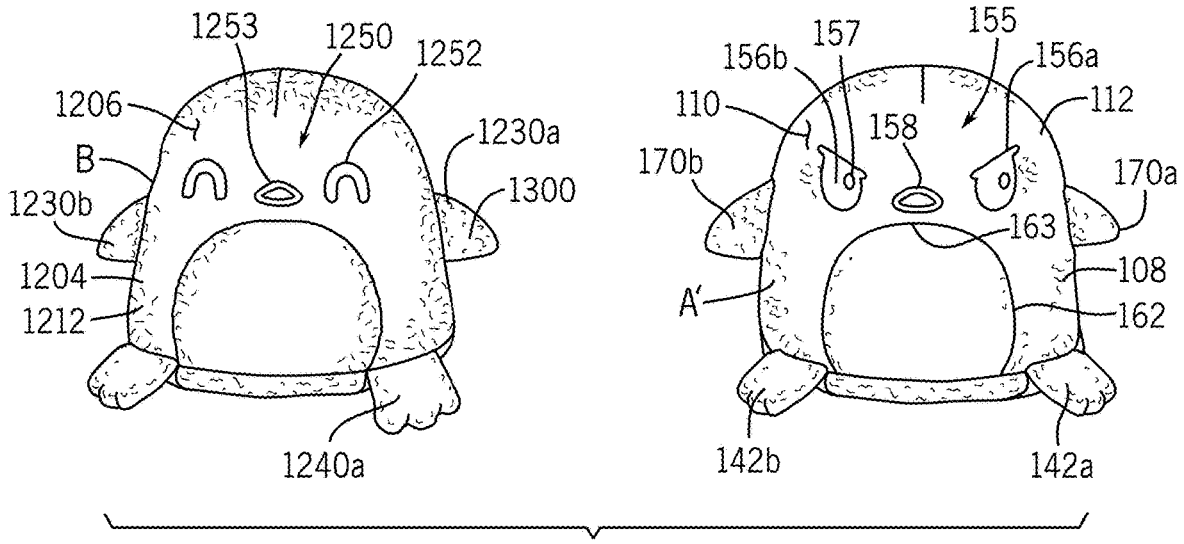
FIG. 15 depicts the pair of reversible toys of FIG. 12 separated from one another with one reversible toy in the first configuration and another reversible toy in the second configuration.

As shown in FIG. 15, the reversible toys 100, 1200 will not be capable of coupling to one another where one toy is in the second or unpleasant configuration. For example, in FIG. 15, the reversible toy 100 is shown in the second configuration A' and the reversible toy 1200 is shown in the first configuration B. In the first configuration B, the reversible toy 1200 displaying the face region 1250 indicates a receptiveness to hand holding and presence of coupling appendages 1230*a*, 1230*b* along the exterior. In the second configuration A', the reversible toy 100 displaying the face region 155 indicates an unreceptiveness to hand holding and presence of non-coupling appendages 170*a*, 170*b* along the exterior. Because the reversible toy 100 is in the second configuration A', the reversible toys 100, 1200 may not be capable of coupling with one another. For example, the non-coupling appendage 170*b* is free of any magnetic materials or other coupling features. Further, the magnetic features of the coupling appendages 130*a*, 130*b* are attenuated or blocked within the body 102 of the reversible toy 100.

Thus while a user may attempt to overlap or arrange the non-coupling appendage 170*b* adjacent the coupling appendage 130*a*, a connection may not be formed.

It will be appreciated that, in other embodiments, one or both of the reversible toys 100, 1200 may maintain one of the happy demeanor or the unpleasant demeanor without being reversible to another demeanor or configuration. For example, the reversible toy 100 may be arranged in the first configuration A with the coupling appendages 130*a*, 130*b* exposed and configured without the optional functionality of being reversible to the second configuration A'. Further, the reversible toy 1200 may be arranged in the first configuration B with the coupling appendages 1230*a*, 1230*b* exposed and configured without the optional functionality of being reversible to the second configuration B'. With the coupling appendages 130*a*, 130*b* of the reversible toy 100 exposed and the coupling appendages 1230*a*, 1230*b* exposed of the reversible toy 1200, the reversible toys 100, 1200 may be releasably coupled to one another as described herein and shown in FIG. 13.

Other examples and implementations are within the scope and spirit of the disclosure and appended claims. Thus, the foregoing descriptions of the specific examples described herein are presented for purposes of illustration and description. They are not targeted to be exhaustive or to limit the examples to the precise forms disclosed. It will be apparent to one of ordinary skill in the art that many modifications and variations are possible in view of the above teachings.

What is claimed is:

1. A reversible toy, comprising:

a body including a first surface and a second surface opposite the first surface, wherein stuffing is positioned between the first surface and the second surface, the body reversible between a first configuration and a second configuration to alternatingly present the first and second surfaces as an outer body surface defining an exterior of the body, the other of the first and second surfaces alternatingly defining a stored body surface defining an interior cavity within the body;

a coupling appendage extending from the first surface and comprising a coupling feature, wherein the coupling feature comprises a coupling appendage material, a magnet, and stuffing, wherein the stuffing is positioned around the magnet and both the stuffing and the magnet are captured by the coupling appendage material, and the coupling feature is configured to couple the reversible toy to a second reversible toy at a corresponding appendage on the second reversible toy; and a non-coupling appendage extending from the second surface separate from the coupling appendage and having a shape that is the same as a shape of the coupling appendage, the non-coupling appendage comprising a non-coupling appendage material, stuffing captured by the non-coupling appendage material and being free of magnetic materials;

wherein in the first configuration the coupling appendage is located at a height on the body and the non-coupling appendage is stored in the body, in the first configuration the reversible toy is configured to couple to the corresponding appendage of the second reversible toy;

wherein in the second configuration the coupling appendage is stored in the body and not visible from the exterior and the non-coupling appendage is located at the height on the body that is the same as a height of the coupling appendage in the first configuration, in the second configuration the reversible toy is configured not to couple to the corresponding appendage of the second reversible toy.

2. The reversible toy of claim 1, wherein the body comprises a first material layer defining the first surface and a second material layer defining the second surface opposite the first surface, the first and second material layers defining an inner body cavity therebetween, the inner body cavity filled with the stuffing, wherein:

the stuffing spaces the first and second material layers apart, the body defines an opening to the interior cavity within the body having a closed top end, and the body is collapsible through the opening and reversible between the first and second configurations to alternatingly present the first and second surfaces as the outer body surface defining the exterior of the body, the other of the first and second surfaces alternatingly defining the stored body surface defining the interior cavity.

3. The reversible toy of claim 1, wherein the coupling feature exerts an attraction force configured to releasably secure the coupling appendage to the corresponding appendage of the second reversible toy, the body is configured to attenuate the attraction force when the coupling appendage is positioned in the interior cavity and prevent the coupling feature from releasably securing the reversible toy to an exterior object.

4. The reversible toy of claim 1, wherein the coupling appendage is a first appendage and the coupling feature is a first coupling feature, and the reversible toy comprises a second coupling appendage attached to the body and comprising a second coupling feature, the second coupling feature configured to couple the reversible toy to the second reversible toy.

5. The reversible toy of claim 4, wherein the magnet of the first coupling feature is a first magnet having a first magnetic polarization, the second coupling feature comprises a second magnet having a second magnetic polarization, and the first and second magnets are arranged within the first and second coupling appendages such that the first and second magnetic polarizations have a common orientation relative to the body.

6. The reversible toy of claim 5, wherein the first and second coupling appendages are attached to opposing sides of the body, and the body has a body shape configured to prevent the first and second coupling features from coupling simultaneously to a common surface.

7. The reversible toy of claim 1, wherein in the first configuration, the first surface includes features representative of a first emotional state;

in the second configuration, the second surface includes features representative of a second emotional state.

8. The reversible toy of claim 1, wherein in the second configuration:

the magnet of the coupling appendage is separated from the second surface of the exterior of the body by the stuffing captured by the coupling appendage material and by the stuffing positioned between the first and second surfaces;

the stuffing captured by the coupling appendage material and the stuffing positioned between the first and second surfaces attenuate a magnetic force exerted by the magnet such that the magnet is prevented from coupling to an object exterior the body.

9. A reversible toy, comprising:

a body comprising a first material layer including a first face region representative of a first emotional state and a second material layer including a second face region representative of a second emotional state, wherein the body is reversible between a first configuration and second configuration in which:

in the first configuration, the first material layer defines an outer body surface of the body and the second material layer defines an interior cavity of the body, and in the second configuration, the second material layer defines the outer body surface and the first material layer defines the interior cavity;

a stuffing trapped between the first and second material layers;

a coupling appendage extending from the first material layer and comprising a coupling feature, wherein the coupling feature comprises a coupling appendage material, a magnet, and stuffing, wherein the stuffing is positioned around the magnet and both the stuffing and the magnet are captured by the coupling appendage material, and the coupling feature is configured to couple the reversible toy to a second reversible toy at a corresponding appendage on the second reversible toy, and the coupling appendage is alternatingly positionable between the outer body surface and the interior cavity based on a configuration of the body in the first or second configurations; and a non-coupling appendage extending from the second material layer separate from the coupling appendage and having a shape that is the same as a shape of the coupling appendage, wherein the non-coupling appendage comprising a non-coupling appendage material, stuffing captured by the non-coupling appendage material and being free of magnetic materials and is alternatingly positionable between the outer body surface and the interior cavity based on a configuration of the body in the first or second configurations;

wherein in the first configuration the coupling appendage is located at a height on the body and the non-coupling appendage is stored in the body, in the first configuration the reversible toy is configured to couple to the corresponding appendage of the second reversible toy;

wherein in the second configuration the coupling appendage is stored in the body and not visible from the exterior and the non-coupling appendage is located at the height on the body that is the same as a height of the coupling appendage in the first configuration, in the second configuration the reversible toy is configured not to couple to the corresponding appendage of the second reversible toy.

10. The reversible toy of claim 9, wherein the coupling feature is concealed within the coupling appendage.

11. The reversible toy of claim 9, wherein the coupling appendage material defining a coupling appendage cavity, and the magnet and the stuffing of the coupling feature are arranged within the coupling appendage cavity.

12. The reversible toy of claim 9, wherein the non-coupling appendage is free of a coupling feature.

13. The reversible toy of claim 9, wherein the coupling appendage extends from the body by an appendage length, and the coupling appendage length is less than half of a maximum diameter of the body.

14. The reversible toy of claim 9, wherein the first and second material layers are coupled to one another along a stitched edge that defines an opening to the interior cavity within the body having a closed top end, and the stitched edge is configured to:

in the first configuration, retain the second material layer within the interior cavity to define the outer body surface from the first material layer, and in the second configuration, retain the first material layer within the interior cavity to define the outer body surface from the second material layer.

15. The reversible toy of claim 14, wherein the coupling feature exerts an attraction force configured to releasably secure the coupling appendage to the corresponding appendage of the second reversible toy object, and the stuffing is configured to attenuate the attraction force to prevent an object from coupling to the reversible toy when the body is in the second configuration.

16. A reversible toy, comprising:

a first material layer and a second material layer separated by stuffing and cooperating to define a body, wherein the first material layer and the second material layer are coupled by a stitched edge defining an opening extending into an interior cavity, wherein the body is collapsible through the opening and reversible between a first configuration and a second configuration to alternatingly present the first material layer and the second material layer as an outer body surface defining an exterior of the body, the other of the first and second material layers alternatingly defining a stored body surface defining the interior cavity;

a coupling appendage extending from the first material layer and configured to move relative to the first material layer, the coupling appendage comprising a coupling feature, wherein the coupling feature comprises a coupling appendage material, stuffing, and a magnet embedded within the stuffing, wherein the stuffing and the magnet are captured by the coupling appendage material, and the coupling feature is configured to releasably couple the reversible toy to a second reversible toy at a corresponding appendage of the second reversible toy; and a non-coupling appendage extending from the second material layer separate from the coupling appendage and having a shape that is the same as a shape of the coupling appendage and configured to move based on movement of the second material layer, the non-coupling appendage comprising a non-coupling appendage material, stuffing captured by the non-coupling appendage material and being free of magnetic materials;

wherein the first material layer is associated with a first set of eyes configured to convey a first emotion;

wherein the second material layer is associated with a second set of eyes configured to convey a second emotion that is different from the first emotion;

wherein in the first configuration the coupling appendage is located at a height on the body and the non-coupling appendage is stored in the body, in the first configuration the reversible toy is configured to couple to the corresponding appendage of the second reversible toy;

wherein in the second configuration the coupling appendage is stored in the body and not visible from the exterior and the non-coupling appendage is located at the height on the body that is the same as a height of the coupling appendage in the first configuration, in the second configuration the reversible toy is configured not to couple to the corresponding appendage of the second reversible toy.

17. The reversible toy of claim 16, wherein the coupling feature is arranged in the coupling appendage to define a lap joint between the coupling appendage and the second coupling appendage.

18. The reversible toy of claim 16, wherein in the first configuration, the non-coupling appendage is fully concealed within the interior cavity, and in the second configuration, the coupling appendage is fully concealed within the interior cavity.

19. The reversible toy of claim 16, wherein the coupling appendage is a coupling appendage of a pair of coupling appendages attached to the first material layer, each coupling appendage of the pair of coupling appendages having a coupling feature, and the coupling features are arranged in the respective coupling appendages such that the body prevents a coupling of the pair of coupling appendage to one another.

* * * * *